US005694789A

United States Patent [19]

Do

[11] Patent Number: 5,694,789

[45] Date of Patent: Dec. 9, 1997

[54] CAM OPERATED DOOR SEAL FOR REFRIGERATOR

[75] Inventor: Gab Bu Do, Kyungsangnam-Do, Rep. of Korea

[73] Assignee: LG Electronics Inc., Rep. of Korea

[21] Appl. No.: 585,664

[22] Filed: Jan. 16, 1996

[51] Int. Cl.[6] ..... F25D 11/02

[52] U.S. Cl. ..... 62/441; 49/371; 312/405

[58] Field of Search ..... 62/440, 441; 49/371, 49/368; 312/296, 405

[56] References Cited

U.S. PATENT DOCUMENTS 5,209,082 5/1993 Ha ..... 62/441

*Primary Examiner*—John M. Sollecito

*Attorney, Agent, or Firm*—Ostrolenk, Faber, Gerb & Soffen, LLP

[57] ABSTRACT

An improved door structure for a refrigerator capable of increasing usable space of refrigerator by removing an intermediate insulation wall of a refrigerating compartment and of preventing cooled air in the refrigerating compartment from discharging to the outside of the refrigerator by providing a door sealing member which includes a door sealing member hinged to the door so as to prevent a cooled air from discharging to the outside of the system and vertically rotatable in the door opening direction, wherein a cam provided at both sides of the door sealing member and a cam guide provided at a side wall of the refrigerating compartment, so that the door sealing member is rotatable in cooperation with the cam and the cam guide.

6 Claims, 6 Drawing Sheets

CAM OPERATED DOOR SEAL FOR REFRIGERATOR

BACKGROUND OF THE INVENTION

1. Field of the Invention

The present invention relates to a door structure for a refrigerator, and in particular to an improved door structure for a refrigerator capable of increasing usable space of refrigerator by removing an intermediate insulation wall of a refrigerating compartment and of preventing cooled air in the refrigerating compartment from discharging to the outside of the refrigerator by providing a door sealing member.

2. Description of the Conventional Art

FIG. 1 shows a conventional refrigerator body 1 having a freezing compartment 2 and two refrigerating doors 3 and 4.

An upper insulation wall 5 is provided at an upper inner portion of the refrigerator body 1 so as to partition a freezing compartment 7 and a first refrigerating compartment 8, and a lower insulating wall 6 is provided at an inner lower portion of the refrigerator body 1 so as to partition the first refrigerating compartment 8 and a second refrigerating compartment 9.

Meanwhile, FIG. 2 shows another conventional refrigerator body 51, which includes a freezing compartment door 52 and a refrigerating door 53.

In addition, an intermediate insulation wall 60 is provided at an inner upper portion of the refrigerator body 51 so as to partition a freezing compartment 57 and a refrigerating compartment 61.

Here, the freezing compartment 7, the first refrigerating compartment 8, and the second refrigerating compartment 9 of FIG. 1 are sealingly separated one another by the upper and lower insulation walls 5 and 6, and the freezing compartment 57 and the refrigerating compartment 61 of FIG. 2 are sealingly separated by the intermediate insulation wall 60. When one door of the doors 2, 3, 4, 52, and 53 is opened, a corresponding freezing compartment or refrigerating is opened.

In drawings, reference numerals 12 and 62 denote a rack, respectively, 13 and 63 denote a vegetable storing box, respectively, and 14 and 64 denote a vegetable storing box cover, respectively.

However, the above-mentioned conventional refrigerators have disadvantages in that in case that a refrigerating compartment is divided into a first refrigerating compartment and a second refrigerating compartment, providing a lower insulation wall is necessary so as to partition them, thus disadvantageously reducing usable space of the refrigerating compartment.

In addition, in case that a refrigerating compartment of the conventional refrigerator is not divided, the refrigerating door can be dropped under its weight, causing malfunctions of the door.

SUMMARY OF THE INVENTION

Accordingly, it is an object of the present invention to provide a door structure for a refrigerator, which overcome the problems encountered in a conventional door structure for a refrigerator.

It is another object of the present invention to provide an improved door structure for a refrigerator capable of increasing usable space of refrigerator by removing an intermediate insulation wall of a refrigerating compartment and of preventing cooled air in the refrigerating compartment from discharging to the outside of the refrigerator by providing a door sealing member.

To achieve the above objects, there is provided a door structure for a refrigerator, which includes a door sealing member hinged to the door so as to prevent a cooled air from discharging to the outside of the system and vertically rotatable in the door opening direction, wherein a cam provided at both sides of the door sealing member and a cam guide provided at a side wall of the refrigerating compartment, so that the door sealing member is rotatable in cooperation with the cam and the cam guide, so that manufacture cost can be reduced and the usable space of the refrigerator compartment can be increased by removing the intermediate insulation wall of the refrigerating compartment.

DETAILED DESCRIPTION OF THE INVENTION

Figure 1:
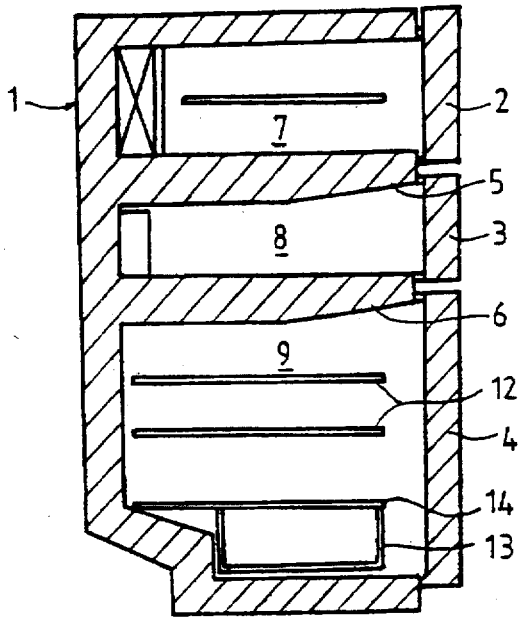
FIG. 1 CONVENTIONAL ART
FIG. 1 is a cross-sectional view showing a conventional refrigerator.
Figure 2:
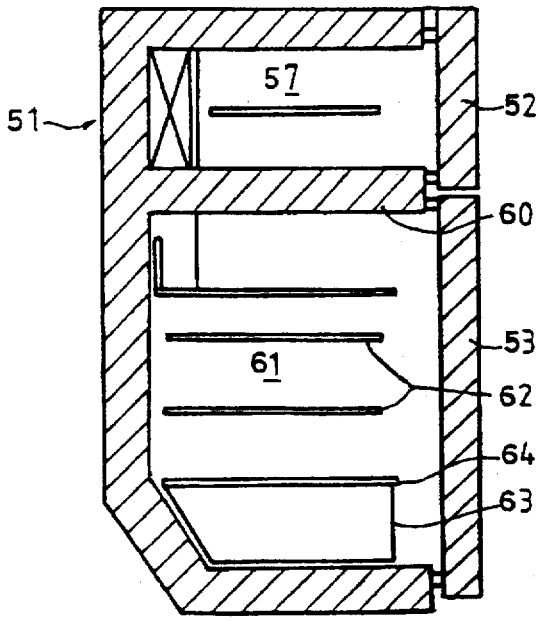
FIG. 2 CONVENTIONAL ART
FIG. 2 is a cross-sectional view showing another conventional refrigerator.
Figure 3:
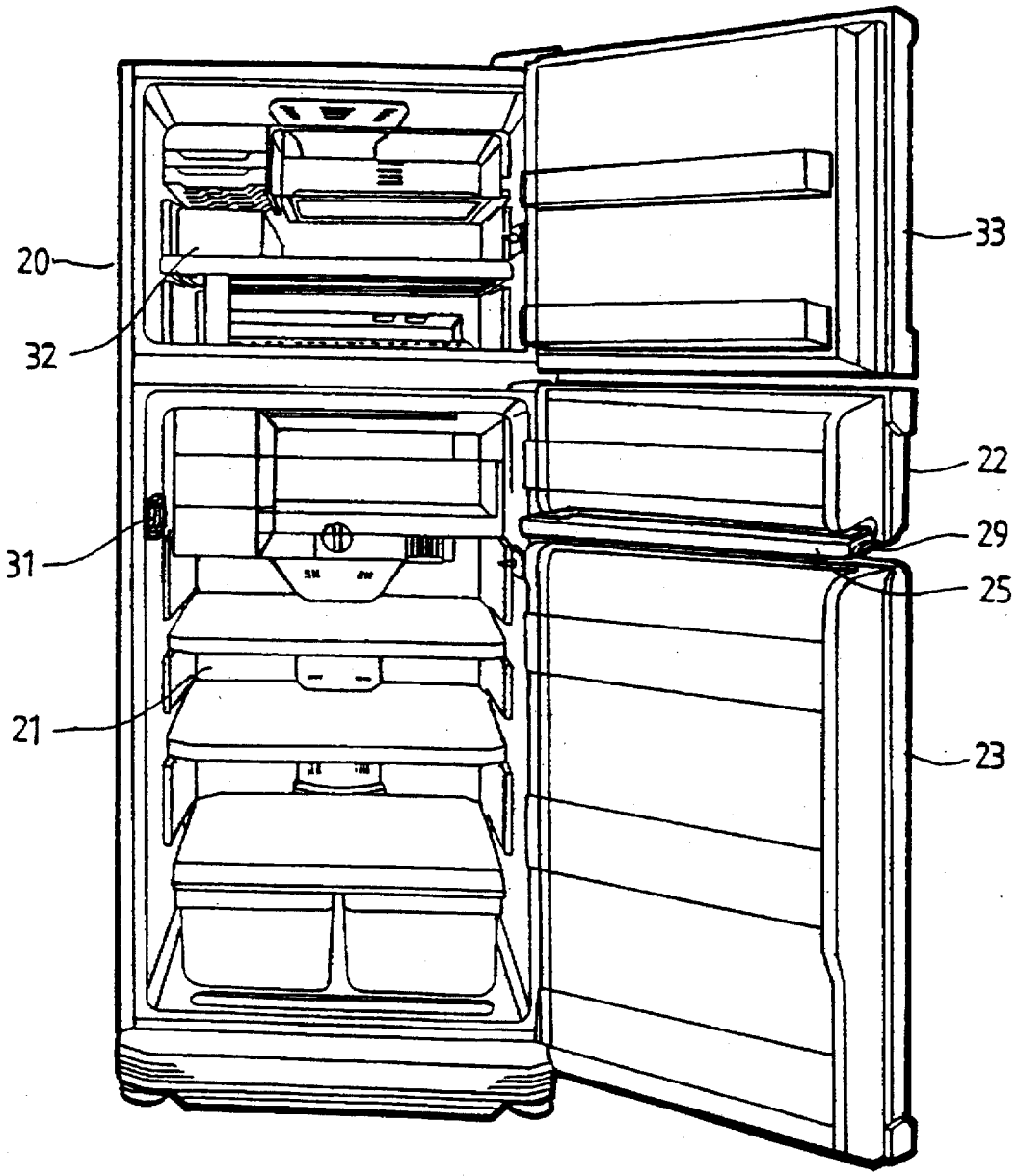
FIG. 3 is a perspective view showing a refrigerator equipped with a door structure according to the present invention.
Figure 4:
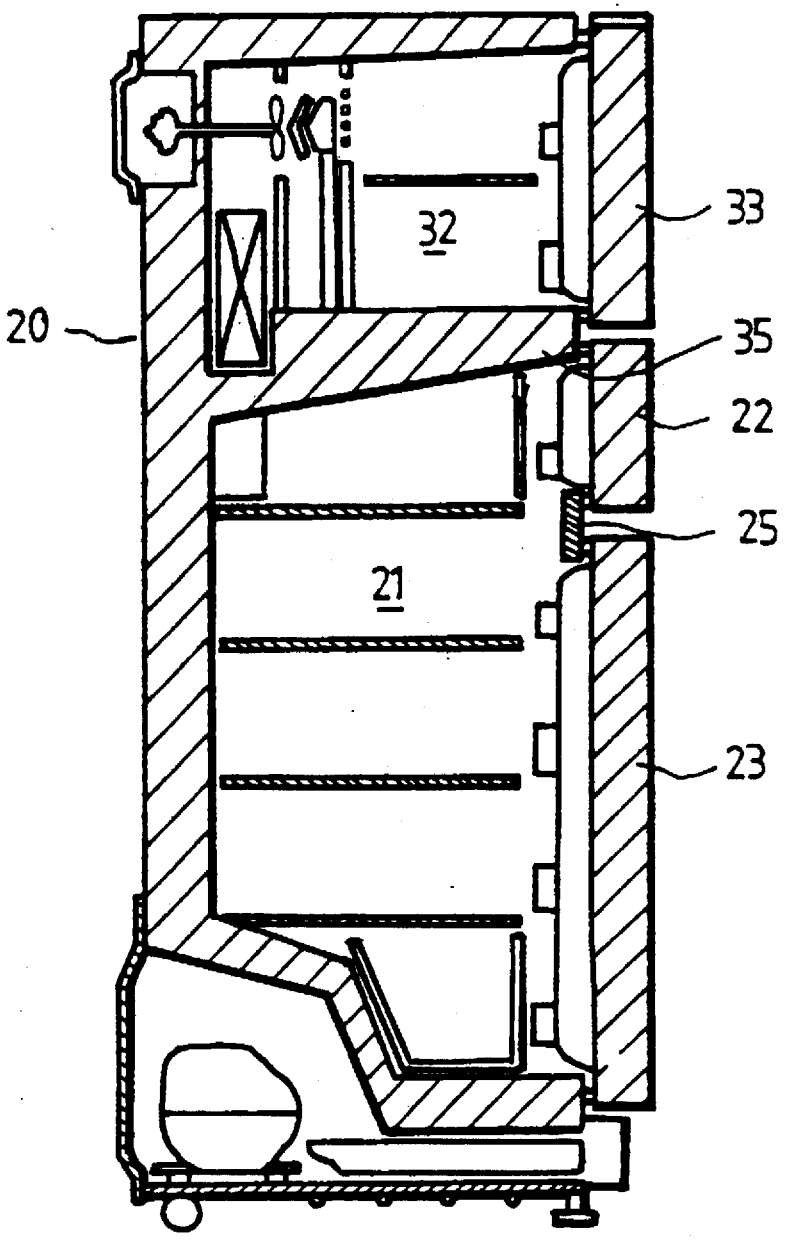
FIG. 4 is a cross-sectional view showing a cross-sectional view showing a refrigerator equipped with a door structure according to the present invention.

FIGS. 3 and 4 show a refrigerator equipped with a door structure according to the present invention, which includes a refrigerating compartment upper door 22 and a refrigerating compartment lower door 23 provided at a refrigerating compartment 21. That is, in the present invention there is not any intermediate insulation walls in the system, thus increasing usable space of the refrigerating compartment 21.

In addition, as shown in FIG. 3, a refrigerating compartment upper door 22 and a refrigerating compartment lower door 23 are provided at the refrigerating compartment 21 of the refrigerator body 20.

Figure 5:
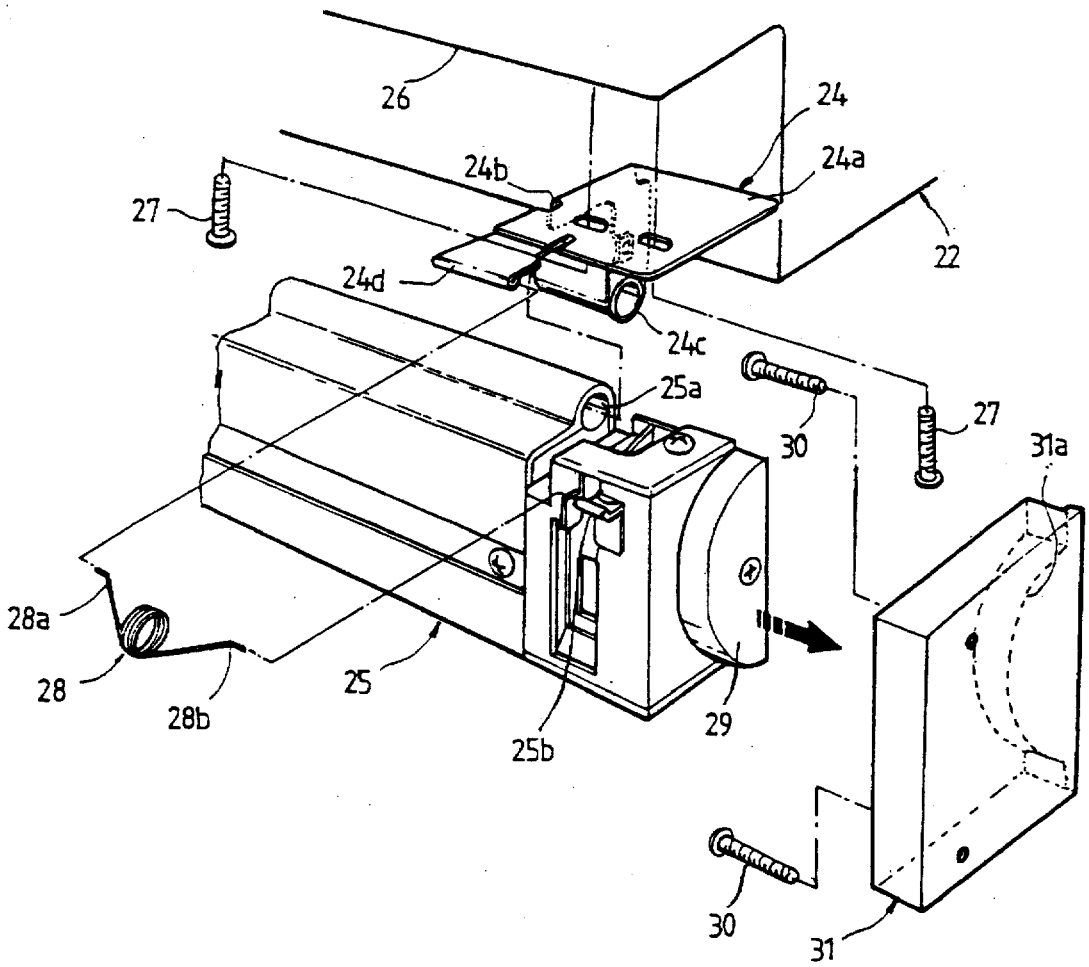
FIG. 5 is an exploded perspective view showing a door structure for a refrigerator according to the present invention.
Figure 6:
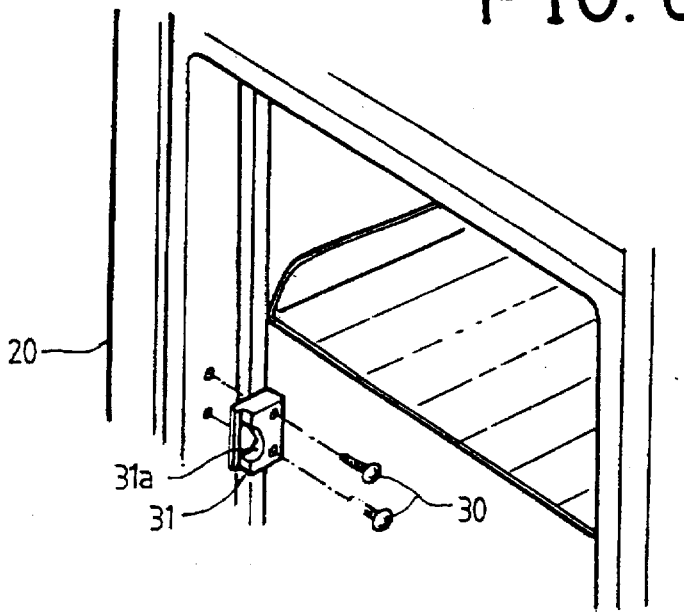
FIG. 6 is a partial perspective view showing a refrigerator equipped with a door structure according to the present invention.

As shown in FIG. 5, a hinge bracket 24 is fixed to both sides of the inner lower portion of the refrigerating compartment upper door 22.

The hinge bracket 24 includes a horizontal fixing plate 24a fixed to the lower portion of the support 26 provided at the inner portion of the refrigerating compartment upper door 22 by a plurality of fixing screws 27, and a vertical plate 24b, which is downwardly curved so as to support the horizontal fixing plate 24a, provided at a predetermined portion of the horizontal fixing plate 24a.

In addition, a hinge shaft 24a is provided at the lower portion of the vertical plate 24b, and an engaging section 24d is provided at one side of the horizontal fixing plate 24a.

Meanwhile, there is provided a door sealing member 25 having a hinge aperture 25a formed at its upper portion, and the door sealing member 25 is engaged to the refrigerating compartment upper door 22 so that the hinge shaft 24c of the hinge bracket 24 is rotatable about the high aperture 25a of the door sealing member 25.

In addition, a torsion spring 28 is provided so as to elastically support the door sealing member 25 in its folding direction, and one end 28a of the torsion spring 28 is engaged to the engaging section 24d of the high bracket 24, and the other end thereof is engaged to the engaging section 25b of the door sealing member 25.

In addition, when the refrigerating compartment upper door 22 is closed, the door sealing member 25 is vertically positioned, and a door supporting member is provided so that the door sealing member 25 can cooperate with the gaskets 22a and 23a provided at the refrigerating compartment upper door 22 and the refrigerating compartment lower door 23.

The door supporting member includes a semicircular plate-shaped cam 29 fixed to one side of the door sealing member 25, and a cam guide 31 having a cam guide surface 31a fixed to the inner wall of the refrigerating compartment 21 of the refrigerator body 20 by a plurality of screws 30.

The outer circumferential surface of the cam comes into contact with the cam guide surface 31a, so that the door sealing member 25 is rotatable.

In the drawings, reference numeral 32 denotes a freezing compartment, 33 denotes a freezing compartment door, 34 denotes a reinforcing member, 35 denotes an insulation wall for partitioning the freezing compartment and the refrigerating compartment, and 22b and 23b denote a magnetic member disposed at the refrigerating compartment upper door and the refrigerating compartment lower door, respectively.

The operation of the door structure of a refrigerator according to the present invention will now be explained with reference to the accompanying drawings.

To begin with, in a state that the refrigerating compartment upper door 22 and the refrigerating compartment lower door 23 of the refrigerator body 20 are closed, as shown in FIG. 4, the door sealing member 25 engaged to the refrigerating compartment upper door 22 is vertically positioned.

Figure 7:
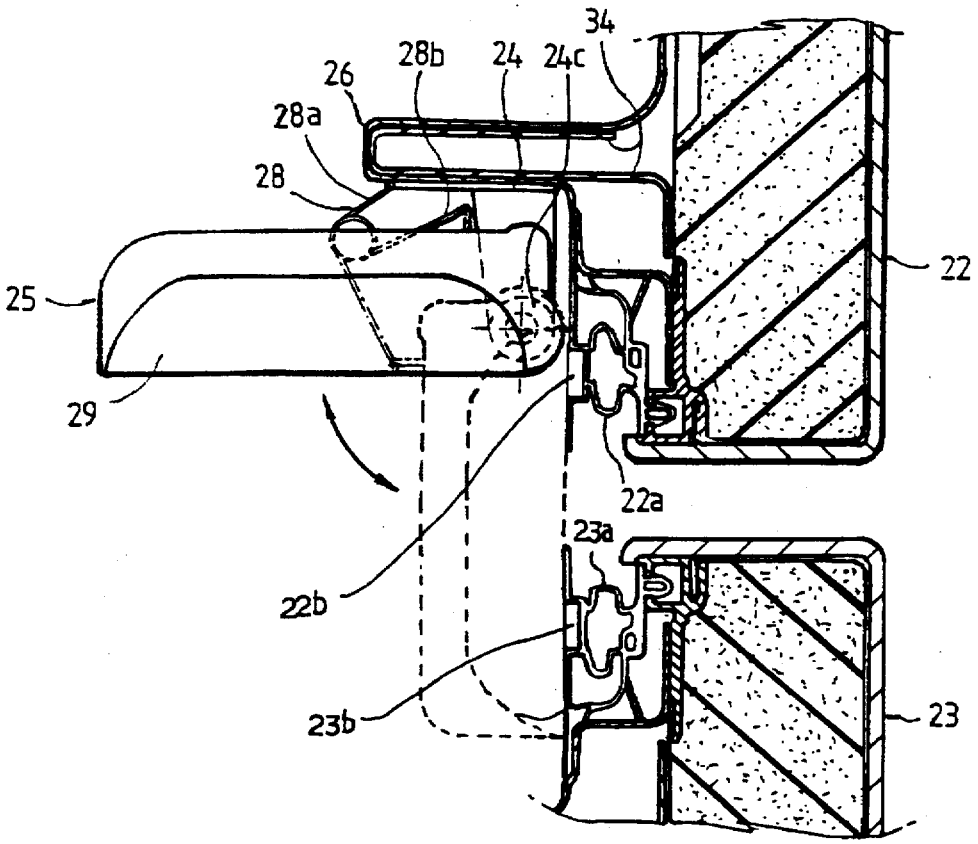
FIG. 7 is a cross-sectional view showing construction and operation of a door structure for a refrigerator according to the present invention.

That is, as shown in FIG. 7, since the front surface of the door sealing member 25 is in contact with the gaskets 22a and 23a of the refrigerating compartment upper door 22 and the refrigerating compartment lower door 23, the cooled air in the refrigerating compartment is prevented from discharging to the outside of the system.

Figure 8A:
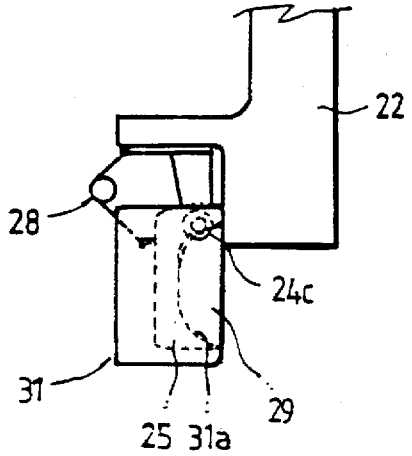
FIG. 8A shows a schematic side view showing a door sealing member when a refrigerating compartment door of a refrigerator equipped with a door structure is closed according to the present invention.

At this time, although the door sealing member 25 is applied with a horizontal force due to an elastic recovering force of the torsion spring 28, and as shown in FIG. 8A, since the rotation of the cam 29 fixed to the one side of the door sealing member 25 is restricted by the cam guide surface 31a of the cam guide 31 fixed to the inner wall of the refrigerating compartment 21 of the refrigerator body 20, the door sealing member 25 keeps is vertical position.

Figure 8B:
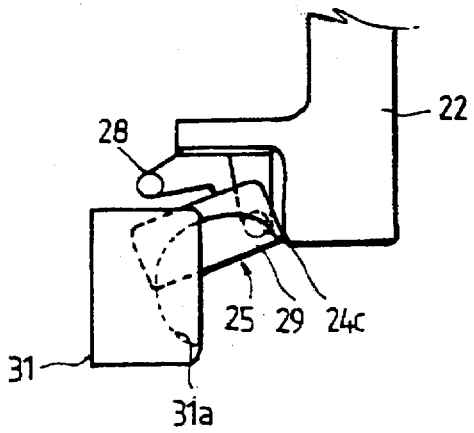
FIG. 8B shows a schematic side view showing a door sealing member position when a refrigerating door of a refrigerator equipped with a door structure is closed/opened according to the present invention.

Meanwhile, when the refrigerating compartment upper door 22 is opened, the cam 29, as shown in FIG. 8B, comes out of the cam guide surface 31a of the cam guide 31, the cam guide 31 is released from the restriction, and the door sealing member 25 becomes rotatable.

Therefore, the door sealing member 25 is rotated from the dotted line to the full line of FIG. 7 due to an elastic recovering force of the torsion spring 28 connected between the hinge bracket 24 fixed to the refrigerating compartment upper door 22 and the door sealing member 25. That is, the door sealing member 25 is rotated clockwise. In addition, the door sealing member 25, as shown in FIG. 8C, is horizontally positioned, and the refrigerating compartment lower door can not be opened due to the opening of the refrigerating compartment upper door 22.

Figure 8C:
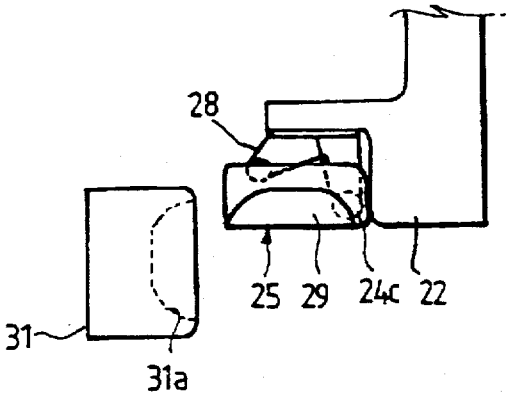
FIG. 8C is a schematic side view showing a door sealing member position when a refrigerating door of a refrigerator equipped with a door structure is opened according to the present invention.

Meanwhile, in case that the refrigerating compartment upper door 22 is closed, as shown in FIG. 8C, since the door sealing member keeps a horizontal state, the door sealing member 25 and the refrigerating compartment lower door 23 are not in contact with each other, and the cam 29 of the door sealing member 25 comes into contact with the cam guide surface 31a of the refrigerator body 20 at the time when the refrigerating compartment upper door 22 is not substantially closed.

Thereafter, since the cam 29 is guided along the cam guide surface 31a of the cam guide 31, the door sealing member 25 can resist the elastic force of the torsion spring 28. The cam 29 moves from the position of FIG. 8B to a position of FIG. 8A. That is, the cam 29 is rotated counterclockwise and returns to the vertical position.

Meanwhile, in case that the refrigerating compartment lower door 23 is opened, since the door sealing member 25 of the refrigerating compartment upper door 22 keeps the vertical position, any discharge of the cooled air from the refrigerating compartment 21 can be prevented.

As described above, the door structure for a refrigerator according to the present invention is directed to providing a door sealing member cooperating with the refrigerating compartment upper door, so that manufacture cost can be reduced and the usable space of the refrigerating compartment can be increased by removing the intermediate insulation wall of the refrigerating compartment.

Although the preferred embodiment of the present invention has been disclosed for illustrative purposes, those skilled in the art will appreciate that various modifications, additions and substitutions are possible, without from the scope and spirit of the invention as described in the accompanying claims.

What is claimed is:

1. A door structure for a refrigerator wherein a refrigerating compartment is divided into first and second refrigerating compartments for selectively maintaining different temperatures therein, comprising:

a first door associated with the first refrigerating compartment and a second door associated with the second refrigerating compartment, the first and second doors being operable and closeable independently of one another;

a door sealing member located between and connected to at least one of said doors so as to prevent cooled air from discharging to the outside of the refrigerating compartments, the door sealing member being vertically rotatable in the door opening direction, a cam provided at two sides of said door sealing member and a cam guide provided at a side wall of the refrigerating compartments, the door sealing member being so disposed as to be rotatable in cooperation with the cam and said cam guide.

2. The door structure of claim 1, including a torsion spring and wherein said door sealing member and said first door are elastically supported by the torsion spring.

3. The door structure of claim 1, wherein said door sealing member is horizontally disposable at a lower portion of the first door.

4. A door structure for a refrigerator having a first refrigerating compartment closed by a first door and a second refrigerating compartment located below the first refrigerating compartment and closed by a second door, the door structure comprising:

a door sealing member connected to the first door;

a cam provided on the door sealing member; and a cam guide provided at a side wall of the refrigerator and engaging said cam for causing the door sealing member having the cam thereon to rotate as the first door opens and closes, whereby the door sealing member assumes a first position when both the first and second doors are closed to prevent cool air in the first and second refrigerating compartments from escaping, and the door sealing member remains in the first position when the second door is opened while the first door remains closed for preventing cool air in the first refrigerating compartment from escaping, and the door sealing member assumes a second position when the first door is opened while the second door remains closed, as the cam rotates in cooperation with the cam guide to allow the first door to open without being obstructed.

5. The door structure of claim 4, wherein a torsion spring is disposed between the door sealing member and the first door, for urging the door sealing member into the second position as the torsion spring contracts when the first door is opened, and for urgingly guiding the door sealing member into the first position as the torsion spring expands when the first door is closed.

6. The door structure of claim 4, wherein the door sealing member is disposed at a lower portion of the first door.

* * * * *